US006961021B2

(12) United States Patent
Hisano

(10) Patent No.: US 6,961,021 B2
(45) Date of Patent: Nov. 1, 2005

(54) WIRELESS NODE THAT USES A CIRCULAR POLARIZED ANTENNA AND A MECHANISM FOR PREVENTING CORNER REFLECTIONS OF AN INSIDE OF A METAL BOX SPACE

(75) Inventor: Atsushi Hisano, San Jose, CA (US)

(73) Assignee: Omron Corporation, Kyoto (JP)

( * ) Notice: Subject to any disclaimer, the term of this patent is extended or adjusted under 35 U.S.C. 154(b) by 159 days.

(21) Appl. No.: 10/230,384

(22) Filed: Aug. 29, 2002

(65) Prior Publication Data

US 2004/0041731 A1 Mar. 4, 2004

(51) Int. Cl.[7] ..... H01Q 1/24
(52) U.S. Cl. ..... 343/702; 343/703; 455/67.11
(58) Field of Search ..... 343/700 MS, 702, 343/703; 455/67.11, 423, 67.1

(56) References Cited

U.S. PATENT DOCUMENTS

| | | | | | |
|---|---|---|---|---|---|
| 4,218,683 | A | * | 8/1980 | Hemming | 343/703 |
| 5,001,494 | A | * | 3/1991 | Dorman et al. | 343/703 |
| 5,119,105 | A | * | 6/1992 | Ngai et al. | 343/703 |
| 5,422,481 | A | * | 6/1995 | Louvet | 250/291 |
| 5,670,965 | A | * | 9/1997 | Tuovinen et al. | 343/703 |
| 5,880,695 | A | * | 3/1999 | Brown et al. | 343/700 MS |
| 6,255,830 | B1 | * | 7/2001 | Rollin et al. | 324/627 |
| 6,525,691 | B2 | * | 2/2003 | Varadan et al. | 343/700 MS |
| 2003/0008620 | A1 | * | 1/2003 | Rowell et al. | 455/67.1 |

FOREIGN PATENT DOCUMENTS

JP 9-274077 A 10/1997

OTHER PUBLICATIONS

"To achieve high–speed wireless LAN in offices", *CRL News*, Japan Ministry of Posts and Telecommunications communications Research Laboratory, Sep. 1994, No. 222, Http://www2.crl.go.jp/kk/e412/CRL_News/back_number/222/222.htm.

"A Study of Printed Polygonal Loop Antennas", Nagaoka University of technology, Http://library.nagaokaut.ac.jp/drdb/h03/k0049.html, Sep. 30, 2003.

* cited by examiner

*Primary Examiner*—Tan Ho
(74) *Attorney, Agent, or Firm*—Foley & Lardner LLP

(57) ABSTRACT

In the present invention, upon reflection of an electromagnetic wave on a metallic surface, a phenomenon is employed that the direction of rotation of a circularly polarized wave is reversed for every reflection. By utilizing a circularly-polarized-wave transmitting and receiving antenna to transmit and receive the circularly polarized wave, the polarized wave of the electromagnetic wave after reflected an odd number of times from the metallic surface has its rotating direction reversed with respect to a receivable rotating direction of the transmitting and receiving antenna, thereby reducing noise caused by the odd number of reflections.

In other words, the reflected wave from the wireless node for communications or measuring of a distance is set to have its rotating direction rendered identical with a rotating direction of the transmitting and receiving antenna. As a result, a signal-to-noise (S/N) ratio is improved, thus facilitating the communications or the measuring of the distance among the wireless nodes disposed in a metal box such as a container. Generally, in the wireless node set or attached onto an inner wall of the rectangular metal box, the radio wave radiated from the node in a downward direction with respect to a horizontal plane (towards a setting wall) will be reflected twice by a corner reflection phenomenon in the vicinity of the corner of the box, and then return to the original wireless node in most cases. The wireless node of the present invention is designed to have its directivity which does not spread in an area under the horizontal plane.

5 Claims, 4 Drawing Sheets

WIRELESS NODE THAT USES A CIRCULAR POLARIZED ANTENNA AND A MECHANISM FOR PREVENTING CORNER REFLECTIONS OF AN INSIDE OF A METAL BOX SPACE

FIELD OF THE INVENTION

The present invention relates to a device attached on an inner wall or a ceiling of a metal box such as a goods container, for performing communications or sensing by means of an electromagnetic wave, and a mechanism for reducing noise upon the communications or the sensing using same.

BACKGROUND OF THE INVENTION

There is a need to perform communications or sensing by attaching a wireless node operable to communicate or sense using a radio wave, on a wall or a ceiling of an inside space of a goods container, a storehouse, an office, or the like. For example, such a need arises from the purpose of easily constructing a local area network using a wireless system in the office, or from the purpose of monitoring opening and closing of a door of the goods container or presence of a hole drilled through the wall from the inside.

http://www2.crl.go.jp/kk/e412/CRL_News/back_number/222/222.htm As mentioned in the description on the above WEB site (Japan Ministry of Posts and Telecommunications Communications Research Laboratory: CRL NEWS 1994.9 No.222 "To achieve high-speed wireless LAN in offices"), when using a radio wave having a millimeter wavelength band for high-speed transmission in a given space, there occurs a transmission distortion due to multipath propagation caused by reflections from a wall, a ceiling, a floor, a utensil, and the like. In addition, there occurs an interruption of a propagation path due to presence of objects like the utensil in the space, or persons walking there. These phenomena lead to significant problems in the system. Generally, when a radio wave of a circularly polarized wave is launched into a wall at a small incident angle and is then reflected off the wall, the polarized wave will reverse its direction of rotation. In a known system, the use of the circularly polarized wave upon the transmission and reception permits excessive reduction in received multipath waves that are caused by an odd number of the reflections of the polarized wave from the wall.

However, in a metal box such as the goods container, there occurs a great number of the multipath reflections. (It is noted that an object whose inner surface is made of metal, and an object serving as a conductor in view of electromagnetics, even if it is composed of the metal with another thin painting or coating, are also hereinafter referred to as the "metal box".) For example, by using a wireless node for transmitting and receiving a right-handed circularly polarized wave in the goods containers, it is possible to reduce considerable influences of the multipath propagation, but harmful influences thereof possibly remain upon communication between the wireless nodes or measuring of a distance between them in the goods container.

PRIOR ART

Japanese Unexamined Patent Publication No. Hei09-274077 discloses a radio wave sensor for monitoring a state inside a goods container. This radio wave sensor is provided with a transmitting means and a receiving means of a wave. The transmitting means outputs a spread spectrum wave dispersed and modulated by a predetermined spread code to a detecting space (for example, in a container), where the spread spectrum wave is reflectable. The receiving means receives a spread spectrum wave whose spread code is the same as that used by the transmitting means. And whenever it receives such a spread wave, it outputs a correlation peak signal according to the intensity of the received spread wave. When something or someone moves in the detecting space, the spread spectrum wave has its propagation path changed in the detecting space, and the output state of the correlation peak signal outputted from the receiving means is changed in accordance with the change of the propagation path. Thereafter, such a change of the output of the correlation peak signal is detected, thereby sensing the movement of something or someone in the detecting space. This prior art technique, however, has the following disadvantages.

1) An eliminating function of a multipath reflected wave relies solely on a separating function of separating a direct wave of reversed spread and the multipath reflected wave by means of a correlation computation using PN code. Thus, when a large number of multipath reflected waves are generated very densely, the direct wave cannot be separated in most cases.

2) The only movement of a baggage makes the state of the multipath reflected wave change, thus leading to misidentification of the change. Even when the sensor is not intended for the monitor of the baggage-movement, but for the detection of the opening and closing of a door of the goods container, the sensor identifies the movement of the baggage, whereby a lot of false reports will be possibly given to a user, thus rendering the sensor unusable.

SUMMARY OF THE INVENTION

The present invention has been accomplished in view of the above-mentioned technical background, and it is an object of the present invention to realize an improvement which permits eliminating harmful influence of a multipath wave by the use of a circularly polarized wave (hereinafter, including elliptically polarized wave) from an antenna of the wireless node, and simultaneously by means of an appropriate directional pattern of the antenna, when communicating or measuring of a distance between wireless nodes, each of which are attached on an inner wall of a metal box (for example, a goods container, a storehouse having a metallic wall). To this end, as shown in FIG. 1, a circularly polarized wave having a first direction of rotation (for example, right-handed circularly polarized wave) is used to exchange a radio wave so as to perform the communications or the measuring of the distance between the wireless nodes. Among the multipath waves reflected from the inner wall of the metal box, the radio waves that are reflected an odd number of times to return towards the wireless nodes, have a rotating direction of the polarized waves reverse to the first rotating direction. So, the antenna of the wireless node is designed to transmit and receive only the circularly polarized wave having the first rotating direction, whereby the radio waves reflected an odd number of times from the inner wall of the metal box will not be received by the wireless node. This allows removal of the greater part of multipath waves. It should be, however, noted that only the aforesaid means cannot remove a multipath wave caused by a phenomenon (namely, corner reflections). That is, it is difficult to remove a multipath wave which is reflected twice from a corner of the metal box, and then proceeds back to the original wireless node in an incident direction of an incident wave as a radio wave having the same rotating direction as that of the incident wave. This is why the described multipath wave returns to the wireless node as a circularly wave having a rotating direction that is receivable by the wireless node. To eliminate or remove the corner reflections or the multipath wave, according to the present invention, the antenna of the wireless node is designed to have its directional characteristics which have lower intensity of radiation and lower sensitivity in a direction towards the corner of the metal box.

DETAILED DESCRIPTION OF THE INVENTION

Hereinafter, some preferred embodiments of the present invention will be described in detail with reference to the accompanying drawings. The size, material, shape, and relative position of each component in the embodiments, unless otherwise specified, are not intended to limit the scope of the present invention, but merely for the illustrative purpose.

Figure 1:
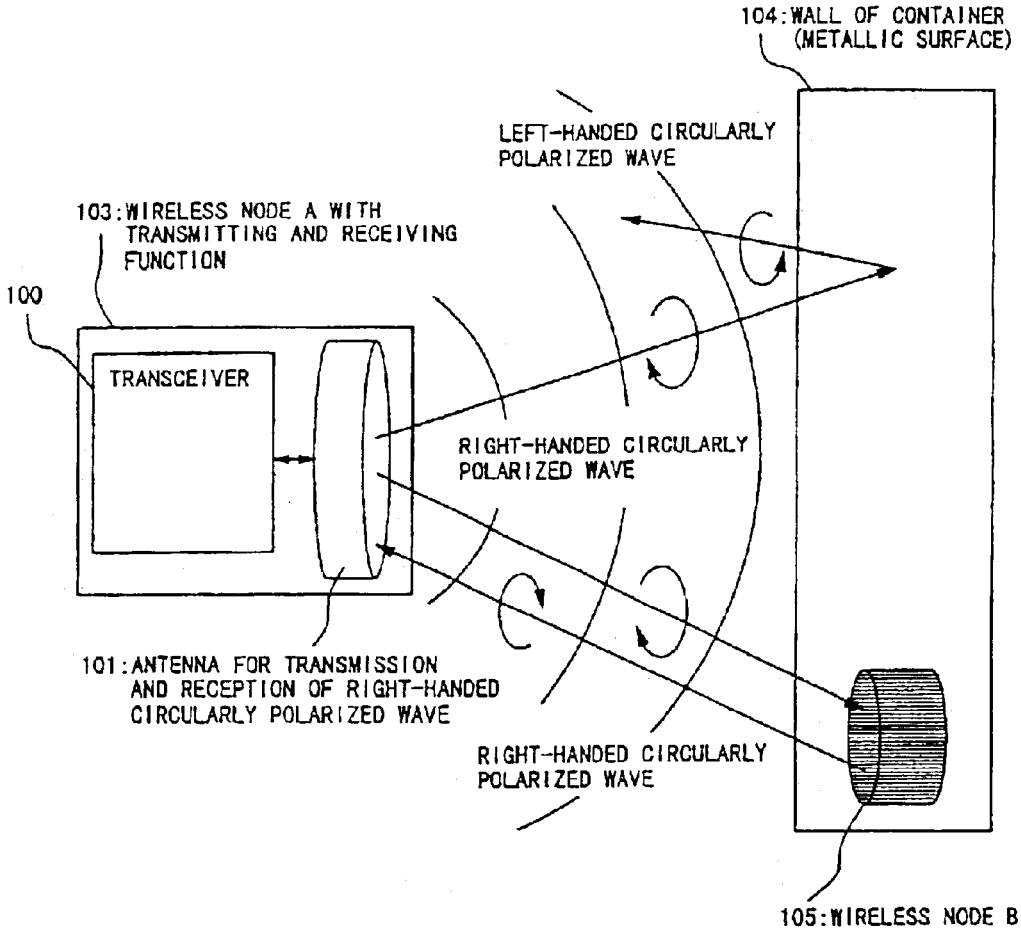
FIG. 1 is a diagram illustrating a state in which a right-handed circularly polarized wave has its direction of rotation reversed when reflected from a surface of a conductor.
Figure 2:
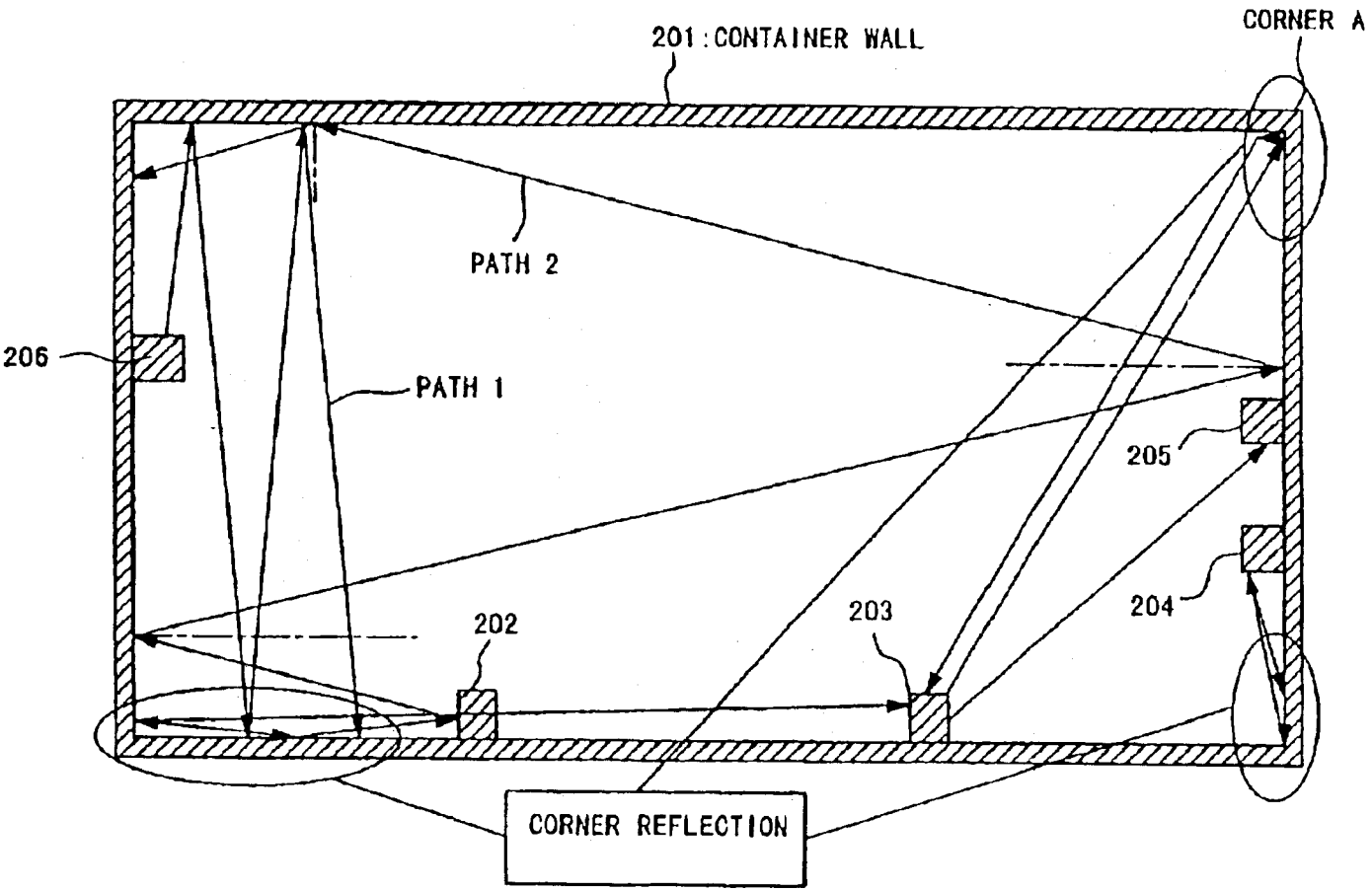
FIG. 2 is an explanatory diagram illustrating reflection of a radio wave radiated by a wireless node attached on a wall of a container.

FIG. 2 is a plan view of a goods container. A side view thereof not shown will be the same.

Wireless nodes 202, 203, 204, 205, and 206 are attached onto inner surfaces of the goods container. When the wireless node is in operation inside a metal box such as the goods container that causes much multipath propagation, the use of a circularly polarized antenna therein permits effective elimination of the harmful influence of reflected waves constructing the multipath. That is, the antenna of the wireless node for transmitting and receiving a right-handed circularly polarized wave is designed to have no sensitivity to a left-handed circularly polarized wave, whereby it does not receive a radio wave that is reflected an odd number of times from a metallic surface at an incident angle close to a vertical incident angle. Thus, the circularly polarized antenna is used for each of the wireless nodes 202, 203, 204, 205, and 206. For instance, the wireless node 202 and the wireless node 204 are used to transmit and receive radio waves so as to communicate and measure a distance therebetween. A radio wave that is radiated by the wireless node 206 to proceed along a path 1 will be reflected several times from side surfaces of the goods container to depart from the wireless node 206. A radio wave that is radiated by the wireless node 202 to proceed along a path 2 will be reflected several times from the walls of the goods container, to depart from or approach the wireless node 202. The common point to these paths is that the radio wave reflected at least twice advances in a direction so that it goes away from the wireless node that has radiated. The radio wave proceeding along the aforesaid path will be attenuated gradually every reflection, and will have passed through a much longer path than the radio wave for the communication or the measuring of the distance. Thus, the path-proceeding radio wave can be obviously distinguished from the communication/measuring radio wave based on a time-axis, thereby to be easily removed. The above-mentioned multipath wave, namely the path-proceeding radio wave almost does not exert a bad influence on the wireless node, resulting in no problem. A radio wave going from the wireless node 202 toward a left-sided corner proceeds along a path, which is shown a "corner reflection" in FIG. 2, and it is then reflected twice from the container walls to return to the original wireless node 202 itself. As can be seen from this path, suppose the wireless node 202 is attached on a horizontal surface of the wall, the radio wave radiated by the wireless node 202 downwardly with respect to the horizontal surface will be reflected twice by corner reflections to return to the wireless node 202 itself in the same direction. As is the case with the wireless node 204, suppose the wireless node 204 is attached on a horizontal surface of the wall, the radio wave radiated by the wireless node 204 downwardly with respect to the horizontal surface will cause the corner reflections at the corners of the container, and be thus reflected twice from the inner wall of the container to return to the wireless node 204 itself. These two cases occur due to the corner reflections at the corners of the walls, on which the respective wireless nodes are attached. It turns out that a distance between the wireless node and the corner where the corner reflection occurs is short. It is apparent that without effectively reducing the reflected waves that are reflected an even number of times by the described corner reflections to return to the respective wireless nodes, the reflected waves could be big noises even if the circularly polarized antenna were utilized.

Figure 3:
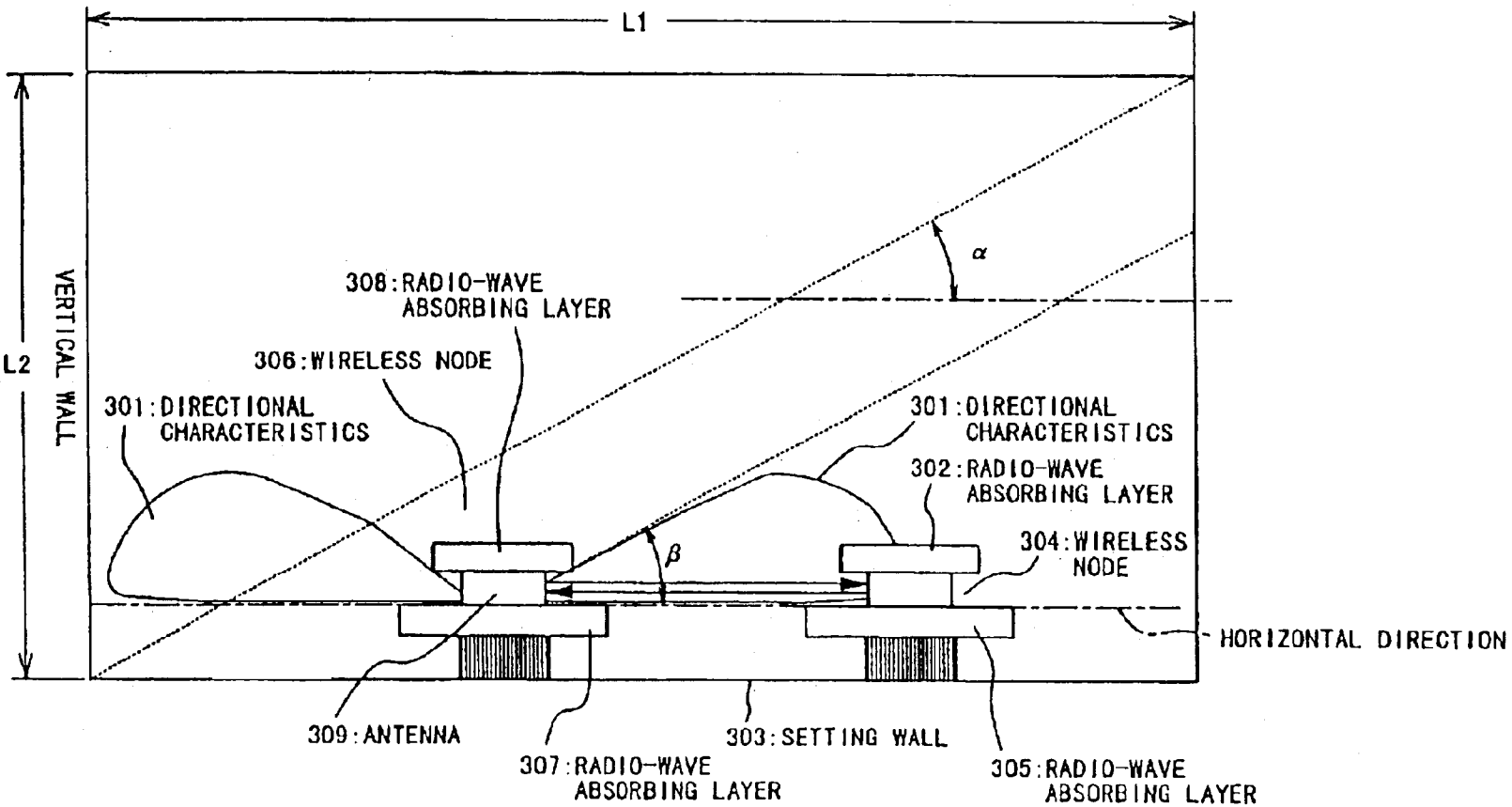
FIG. 3 is an explanatory diagram of a directional pattern of a wireless node that does not cause corner reflections at a corner of the container according to the present invention.

Then, as shown in FIG. 3, the wireless node 306 according to the present invention, namely an antenna employed by the node has directional characteristics which are prevented from spreading downwardly with respect to the horizontal direction or plane (that is, towards a setting surface on which the wireless node is attached.) In other words, the wireless node comprises an antenna which never radiates any radio waves in the downward direction with respect to the horizontal direction, and which has hardly any sensitivity to radio waves coming therein from the lower side relative to the horizontal direction. Such an antenna with the described directional characteristics is obtained by the use of a radio-wave absorber. In more detail, beneath an antenna 309 of the wireless node 306, a flat radio-wave absorbing layer 307 is disposed. The radio-wave absorbing layer may be made of ferrite or polyurethane foam. The radio-wave absorbing layer 307 is designed to absorb a radio wave radiated by the antenna 309 in the downward direction with respect to the horizontal direction. As a result, the wireless node will have the directional characteristics in which the radio wave radiated downwardly respective to the horizontal direction is smaller in intensity of radiation, and sensitivity. It should be noted that there are other methods or mechanisms for controlling the directional characteristics of the wireless node 306 such that it does not spread downwardly respective to the horizontal direction. For instance, the use of an array antenna, and the setting of an arrangement and a phase of a micro-antenna could keep the directional characteristics from extending downwardly with respect to the horizontal direction. Similarly, a printed antenna having appropriate patterns can achieve the same directional characteristics.

On the other hands, there could occur some cases in which the radio wave radiated by the wireless node 203 towards the corner A is reflected twice by the corner reflection to return to the wireless node 203 itself. In this case, since the radio wave after being reflected twice has passed through a long path from the last reflected point of the wall to the original node, it will rarely become a significantly obstructive wave. However, there is often a need to completely prevent such a corner reflection. For this need, according to the preferred embodiment, the directional characteristics of the wireless node is controlled and set in such a manner that the wireless node never radiates any radio waves to proceed towards the corner A. In more detail, the present invention employs the following mechanism.

The wireless node 306, as shown in FIG. 3, has its directional characteristics set so as to satisfy a formula below, whereby no corner reflection at the corner A will be received, even if the wireless node 306 is located on any other place of the setting wall 303.

$$\beta<\alpha$$

$$\tan \alpha=L2/L1$$

wherein L1 is the width of the container, and L2 is the height of the container, as illustrated in FIG. 3.

To keep the directional characteristics from spreading outward from the range defined by the angle β, a radio-wave absorbing layer 308 is disposed on the antenna 309, which layer 308 absorbs radio waves to extend out of the range set by the angle β. It is noted that not only the radio-wave absorbing layer, but also the array antenna or the printed antenna with appropriate patterns may be employed so as to obtain the antenna having the above-mentioned directional characteristics.

Figure 4:
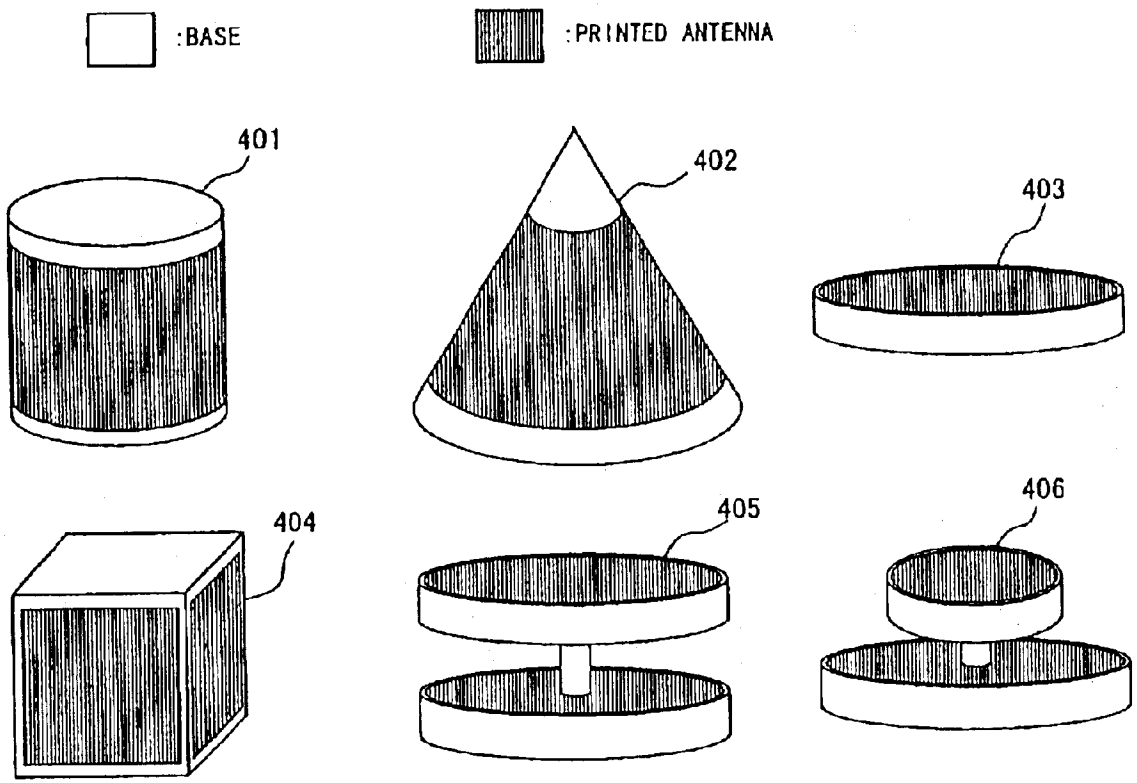
FIG. 4 is an exemplary diagram illustrating some embodiments of an antenna serving as the wireless node according to the present invention.

FIG. 4 shows exemplary embodiments of the antenna. The antenna 309 of FIG. 3 is a cylindrical dipole antenna, but the present invention is not limited to this case. Various types of antennas may be used as the antenna. In particular, any one of the antennas 403, 404, 405 and 406 may be a plane printed antenna, thereby permitting reduction in manufacturing cost and weight.

In sensing the radio waves, UWB (Ultra Wide Band) should be utilized so as to withstand the multipath propagation in the metal box like the goods container, to resist influences of cargoes therein, and to save power consumption. Thus, an antenna in the wireless node should be a wide-range circularly polarized antenna. As to a printed antenna suitable for the wide-range band which allows reduction in size, weight and cost, and which makes a circularly polarized wave available, see a paper titled "Printed Polygonal Loop Antenna" (Ph.D. dissertation at Nagaoka University of Technology) on the following Web site.

http://library.nagaokaut.ac.jp/drdb/h03/k0049.html

Further, a fractal antenna may be used as a printed antenna suitable for the wide-range band which permits reduction in size, weight and cost, and which makes the circularly polarized wave available.

For the simple explanation, the aforesaid goods container has been shown and explained as a four-sided figure on the basis of the attached drawings. In reality, the goods container is a rectangular parallelepiped, namely, a box. But if the goods container were explained and regarded as the box in the specification, the features of the wireless node would be the same, in that the corner reflection occurs on the inner wall of the goods container and is caused by the radio wave radiated towards the corner, and that there is the case where the strong radio wave reflected twice could return to the original wireless node, and that the wireless node should have its directional characteristics that prevents the radio wave from being radiated to the wall side (downwardly with respect to the horizontal direction) on which the wireless node is attached, so as to eliminate the corner reflections.

As can be seen from the above description, in the wireless node of the present invention, the following mechanisms or means are employed: 1) By reducing the directional characteristics of the wireless node that proceeds towards the setting surface side of the node, the corner reflections within a close range are prevented, so that the harmful influence of the multipath propagation can be eliminated; 2) By utilizing the circularly polarized wave, the multipath waves reflected an odd number of times can be removed; 3) By means of the wide-range radio wave such as the UWB, the durability to the multipath propagation is improved; and 4) By preventing a directivity of the antenna from spreading outward from a predetermined angle determined by a length-to-width ratio of the metal box, the corner reflections at the corner far from the antenna are prevented, thereby reducing the bad influence of the multipath propagation. As mentioned above, in the present invention, there are provided various means or mechanisms in stages for preventing the influences of the multipath waves. Based on the relationship among the inner state of the metal box, the frequency of the radio wave to be used, the size of the metal box, and the like, one or more foregoing means required for should be selected and combined, thereby excessively eliminating the influences of the multipath waves.

What is claimed is:

1. A wireless node attached on an inner wall of a metal box, comprising an antenna, wherein said antenna to be used in the wireless node has directional characteristics which are prevented from spreading towards said inner wall, wherein the metal box has a rectangular solid shape, and wherein the directional characteristics of the antenna to be used in the wireless node prevents reception of electromagnetic waves emitted from the wireless node and reflected twice or more on an inner wall of the box.

2. A wireless node attached on an inner wall of a metal box, comprising an antenna for transmission and reception of only a circularly polarized wave having one direction of rotation, wherein said antenna has directional characteristics which are prevented from spreading towards said inner wall.

3. A wireless node attached on an inner wall of a metal box, comprising an antenna, wherein said antenna to be used in the wireless node has directional characteristics which are prevented from spreading towards said inner wall, and from spreading outward from a predetermined angle determined by a length-to-width ratio of the metal box.

4. A wireless node attached on an inner wall of a metal box, comprising an antenna for transmission and reception of only a circularly polarized wave having one direction of rotation, wherein said antenna to be used in the wireless node has directional characteristics which are prevented from spreading towards said inner wall, and from spreading outward from a predetermined angle determined by a length-to-width ratio of the metal box.

5. A wireless node attached on an inner wall of a metal box, comprising a printed antenna for transmission and reception of only a circularly polarized wave having one direction of rotation, wherein said antenna is a wide-range antenna arranged in a fractal pattern, and has directional characteristics which are prevented from spreading towards said inner wall.

* * * * *